US005224708A

United States Patent [19]

Gathman et al.

[11] Patent Number: 5,224,708

[45] Date of Patent: * Jul. 6, 1993

[54] SYMMETRICAL DICE WITH CARD INDICIA

[76] Inventors: Richard W. Gathman, 42 N. 4th St.; Jeffrey M. Breed, 1611 St. Mary St., both of Lewisburg, Pa. 17837

[ * ] Notice: The portion of the term of this patent subsequent to Sep. 8, 2009 has been disclaimed.

[21] Appl. No.: 869,189

[22] Filed: Apr. 16, 1992

Related U.S. Application Data

[63] Continuation of Ser. No. 704,859, May 21, 1991, Pat. No. 5,145,175, which is a continuation of Ser. No. 454,403, Dec. 21, 1989, abandoned.

[51] Int. Cl.[5] ..... A63F 9/04

[52] U.S. Cl. ..... 273/146; 273/306

[58] Field of Search ..... 273/146, 292, 306

[56] References Cited

U.S. PATENT DOCUMENTS

| | | | |
|---|---|---|---|
| 645,112 | 3/1900 | Mapes | 273/146 |
| 809,293 | 1/1906 | Friedenthal | 273/146 |
| 1,523,615 | 1/1925 | Stern | 273/146 |
| 2,004,707 | 6/1935 | Perkins | 273/146 |
| 3,608,905 | 9/1971 | Edison | 273/146 |
| 3,959,893 | 6/1976 | Sigg | 35/31 |
| 4,465,279 | 8/1984 | Larson | 273/146 |
| 4,497,487 | 2/1985 | Crippen | 273/146 |

*Primary Examiner*—V. Millin
*Assistant Examiner*—Raleigh W. Chin
*Attorney, Agent, or Firm*—Lorusso & Loud

[57] ABSTRACT

12-sided and 20-sided dice are disclosed which have a suit symbol and a value symbol on each surface representing one of the various playing cards in a standard 52 card playing deck. The 12-sided die will carry 3 different value symbols for each of the 4 suits and, accordingly, will depict 12 different cards, one on each of its surfaces which are identically shaped pentagons. A game is disclosed which employ three or more of such dice, all identical. In another embodiment a 20-sided die is provided which carries 5 values of each of the four suits. In all embodiments, parallel, opposing surfaces will bear the same value symbol and no two surfaces adjoined together along a common edge will bear the same suit symbol. This symmetrical arrangement provides for integrity of chance in re-rolling the dice and complete randomness of chance.

6 Claims, 1 Drawing Sheet

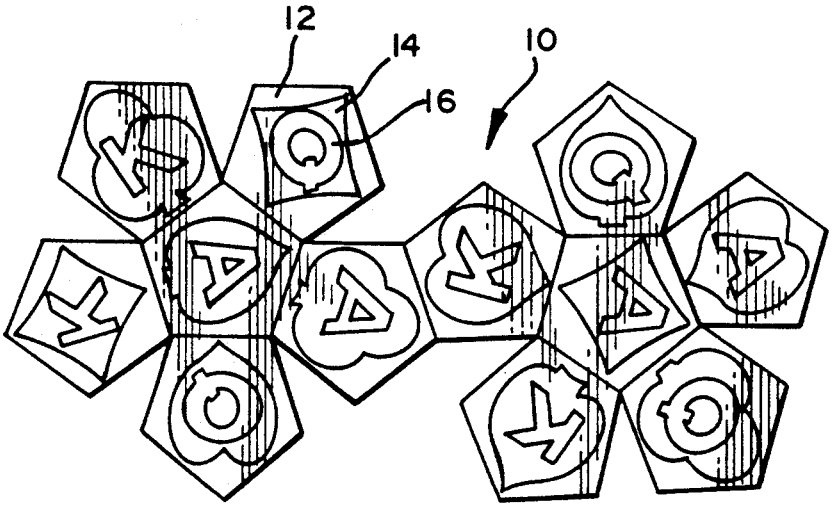
FIG. 1
FIG. 2
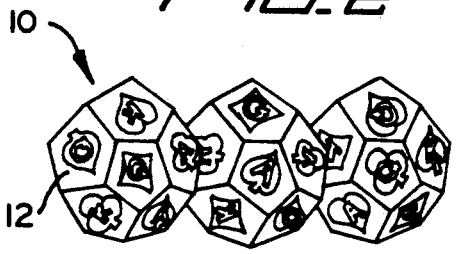
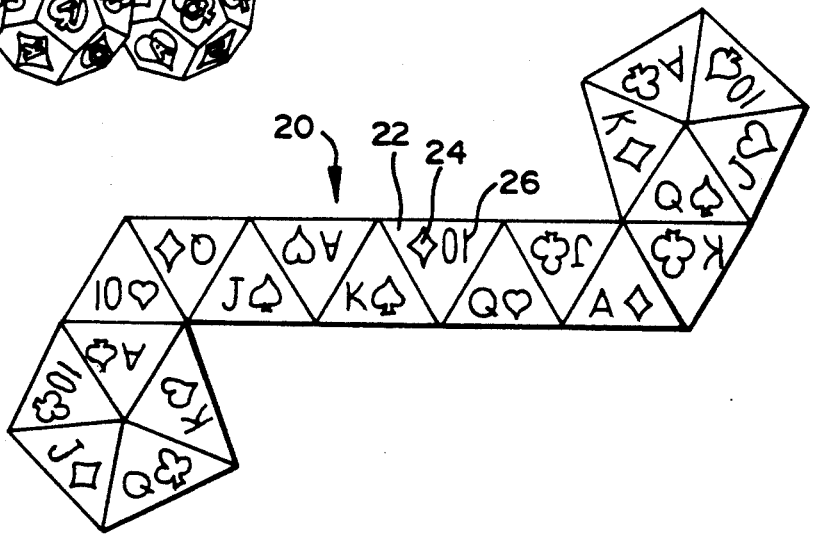
FIG. 3
FIG. 4
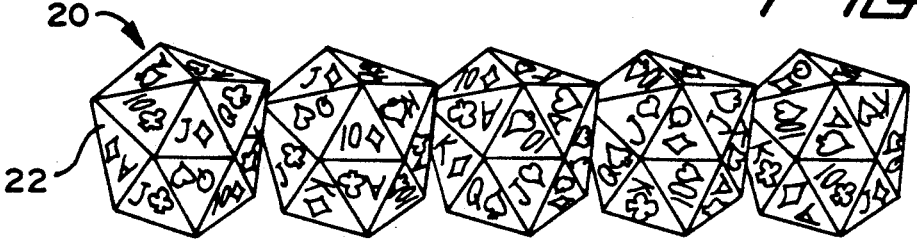

SYMMETRICAL DICE WITH CARD INDICIA

This is a continuation of application Ser. No. 07/704,859 filed May 21, 1991, now U.S. Pat. No. 5,145,175, which is a continuation of Ser. No. 07/454,403 filed Dec. 21, 1989 and now abandoned.

FIELD OF THE INVENTION

This invention relates to a novel die and sets thereof for use in various games of chance.

BACKGROUND OF THE INVENTION

Dice bearing card symbols have previously been developed for a variety of games. For example, U.S. Pat. No. 3,608,905, issued to Robert W. Edison, discloses a set of five twelve-sided, i.e. dodecahedron, dice intended for use in a game simulating poker. However, the dice set of Edison and the simulated poker game he describes lack the characteristics of "integrity of chance" and "total randomness." By "integrity of chance" is meant that some chance does exist in fact. In the case of the five dice set of Edison play can lead to situations where no chance at all exists upon a further roll of a die. For example, using Edison's set with reference to "Table 1" of his patent, if a player has rolled all five dice and has come up with AH-AS-AD-9C-Joker he may decide to roll the Joker again hoping for either the fourth ace (for four of a kind) or another nine (for a full house). Unfortunately, however, perhaps unknown to him, both such rolls are impossible because the die he is re-rolling (Die E) contains neither an ace nor a nine. What is meant by "total randomness" can also be illustrated with reference to "Table 1"of Edison. For example die A contains three spades, three hearts and three diamonds, but only two clubs and, thus, upon re-rolling die A, the odds are against rolling a club. Edison acknowledges some of these deficiencies at column 3, lines 44–54 and at column 4, lines 63–75.

SUMMARY OF THE INVENTION

Accordingly, it is an object of the present invention to provide game dice having integrity of chance and total randomness.

Toward this end, the present invention provides a novel die and a set of at least three thereof wherein each die has N number of identically shaped flat surfaces wherein $N=8n+4$ and n is a whole integer of at least one. Each surface on the die bears a symbol from a first set and a symbol from a second set which when matched by chance with the same first set symbol and/or second set symbol on another die or dice, points are earned or moves made in accordance with the rules of the particular game being played. In the case of simulated card games the first set of symbols will be composed of the four suits, i.e. spades, hearts, diamonds and clubs, and the second set of symbols will consist of card values. Thus, in the card game embodiments each surface on a die indicates a different card chosen from the 52 cards in a standard deck of playing cards. Each die has paired opposing parallel surfaces bearing the same second set symbol, e.g. card value. No two surfaces adjoining along an edge of the die bear the same first set symbol, e.g. card suit. As a consequence, looking at the center position surface with a line of vision at a right angle thereto, in the case of an embodiment wherein $n=1$ (a dodecahedron), the first set symbol on that center surface will not be seen on any other visible surface. For example, if the ace of spades in the embodiment of FIG. 1 is centered, no other black spade will be seen on any of the other five visible surfaces. Such an arrangement provides a perfect design "balance" and totally random chance on every roll.

The dice of the present invention are symmetrically balanced in a manner which mathematically assures equal and random chances on every roll. In the case of a dodecahedron ($n=1$), with its twelve surfaces indicating twelve different cards with three value symbols for each of the four suits, assuming, for example, that the three value symbols are Ace, King and Queen, the suit and value symbols would be arranged in such a manner that:

Aces always oppose Aces;
Kings always oppose Kings; and
Queens always oppose Queens.

In the case of a twenty-sided die ($n=2$), with its twenty surfaces indicating twenty different cards with five value symbols for each of the four suits, assuming, for example, that the five value symbols are Ace, King, Queen, Jack and ten, the suits and value symbols would be arranged in such a manner that:

Aces always oppose Aces;
Kings always oppose Kings;
Queens always oppose Queens;
Jacks always oppose Jacks; and
Tens always oppose Tens.

BRIEF DESCRIPTION OF THE DRAWINGS

Referring to the drawings in which several preferred embodiments of the invention are illustrated:

FIG. 1 is a developed schematic view showing all surfaces of a dodecahedron die which is one embodiment of the present invention;

FIG. 2 is a schematic view of a set of three of the dice depicted in FIG. 1;

FIG. 3 is a developed schematic view showing all surfaces of a twenty-sided die which is another embodiment of the invention; and FIG. 4 is a schematic view of a set of five of the dice depicted in FIG. 3.

DESCRIPTION OF THE PREFERRED EMBODIMENTS

FIGS. 1 and 2 illustrate an embodiment of the invention in the form of a dodecahedron 10, having twelve pentagonal surfaces 12 of equal area. Each pentagonal surface 12 carries a card suit symbol 14 and a card value symbol 16. Each die 10 of the set of three shown in FIG. 2 is identically configured with the Ace, King and Queen of each suit distributed over its twelve surfaces in such a manner that a value symbol 16 on one surface is always opposed to the same value symbol on the opposing parallel surface on the opposite side of the die 10. In other words, Aces oppose Aces, Kings oppose Kings and Queens oppose Queens.

FIGS. 3 and 4 illustrate a second embodiment of the present invention which is a twenty-sided die 20. FIG. 4 shows a set of five identical such dice. Each triangle surface 22 of the die 20, bears a value symbol 26 and a suit symbol 24. As in the case of the first mentioned embodiment, no two surfaces on die 20, adjoining along a common edge, bear the same suit symbol. However, in the case of die 20, unlike the embodiment of die 10, a triangular surface 22 may touch, at one apex, the apex of another triangular surface bearing the same suit symbol.

The games described below employ the dice described and claimed herein (hereinafter "TIBBIT" TM dice) and, in addition to the novel dice, a set of conventional poker chips. The first two games employ the dodecahedron embodiment illustrated in FIGS. 1 and 2 and the following point values may be assigned:

TABLE A

| Mark | Mark Values Point Value | Combination |
|---|---|---|
| Tibster | 10 | 2 Identical Faces |
| Royal Flush | 7 | A-K-Q Same Suit |
| Flush | 4 | All Same Suit |
| 3-of-a-Kind | 3 | 3 A's, etc., Mixed Suits |
| Run | 2 | A-K-Q Mixed Suits |
| Pair | 1 | 2 A's, etc., Mixed Suits |

TABLE B

| Chip Color | Chip Values Points |
|---|---|
| Black | 20 |
| Red | 10 |
| Blue | 5 |
| Green | 1 |

3-ON-A-MATCH

This game employs 100 conventional poker chips (25 of each color and three identical 12-sided TIBBITS TM dice as illustrated in FIGS. 1 and 2. To begin the game all 100 chips are placed in the center of the playing surface to form a pot and player A selects 3 TIBBITS TM dice and rolls them randomly from a tumbler. Scoring then beings with player A selecting any single TIBBIT TM die from among the 3 previously rolled and rerolls that TIBBIT TM die. Player A then scores the value for his roll and draws that value in chips from the pot (see Tables A and B above). He then passes the tumbler and the next roll to player B on his left. Likewise, player B selects any single previously rolled TIBBIT TM die and re-rolls—with the exception that he may not re-roll the exact same TIBBIT TM die that player A rolled. Player B totals the value of his roll and draws that value in chips from the pot. He then passes the tumbler for the next roll to the player on his left. Play continues in this manner until all chips are gone from the pot. The player with the highest point value is the winner.

DOUBLE UP

This game also employs 100 conventional poker chips (25 of each color) and four identical 12-sided TIBBITS TM dice as illustrated in FIGS. 1 and 2. As in the previously described game, all 100 chips are placed in the center of the playing surface to form a "pot." Player A takes 4 TIBBITS TM dice and rolls them randomly from a tumbler. Player A may reroll up to 2 TIBBITS TM dice at his option. He then totals the value of the highest combination of any 3 TIBBITS TM dice among the 4 TIBBITS TM dice and draws that value in chips from the pot (see the Tables above). He then passes the tumbler and the next roll to player B on his left. In a similar manner, player B may then select any 2 TIBBITS TM dice and re-roll—with the exception that he may not re-roll the exact same 2 TIBBITS TM dice that player A rolled. Player B totals the value of the highest combination of any 3 TIBBITS TM dice among the 4 TIBBITS TM dice he rolled and draws that value in chips from the pot. He then passes the tumbler for the next roll to the player on his left. Play continues until all the chips are gone from the pot. The player with the highest point value is the winner.

BEAT YOUR BUDDIES (GRAND TIBBITS TM)

This game employs a set of five identical GRAND TIBBITS TM dice as illustrated in FIGS. 3 and 4 and a bank of 100 conventional poker chips. The mark values and chip values are as shown, respectively, in Tables C and D below.

TABLE C

| Mark | GRAND TIBBIT TM Mark Values Score | Combination |
|---|---|---|
| Grand Tibster | 100 | 5 Identical Faces |
| Royal Grand Flush | 90 | A-K-Q-J-10 Same Suit |
| 5-of-a-Kind | 80 | 5 A's, etc. Mixed Suits |
| 4-of-a-Kind | 70 | 4 A's, etc. Mixed Suits |
| Grand House | 60 | Full House, 2 Suits |
| Flush | 50 | All Same Suit |
| Full House | 40 | 3-of-a-Kind & a Pair |
| 3-of-a-Kind | 30 | 3 A's, etc. Mixed Suits |
| Grand Straight | 20 | A-K-Q-J-10 Mixed Suits |
| Straight | 10 | Run-of-Four, Mixed Suits |

TABLE D

| Chip Color | Chip Values Points |
|---|---|
| Black | 250 |
| Red | 100 |
| Blue | 50 |
| Green | 10 |

Player A begins his turn by rolling (a maximum 3 rolls) all 5 GRAND TIBBITS TM dice to "Set the Mark." He scores the value of his best roll—his "Mark"—and places the corresponding value of chips (see Table D) from the chip bank into the pot. He then passes the GRAND TIBBITS TM dice to the player on his left—player B. Player B must now roll to beat the mark. Should player B fail to beat the mark, the pot is collected by the player on his right who set the mark, player A. However, if player B beats the mark set by player A, he has established a new mark and adds the corresponding chips to the pot. He then passes the GRAND TIBBITS TM dice to the next player on his left. The round continues until a player fails to beat the mark ("Misses the Mark"). The pot is then collected by the player on his right—the player who set the mark. The player who missed the mark now rolls to begin the next round.

Whenever a player misses the mark, he surrenders the pot to the player who passed him the GRAND TIBBITS TM dice, always the player on his right. Whenever a player beats the mark, he adds the corresponding value of chips to the pot and passes the TIBBITS TM to the player on his left. A player must beat the mark to win; ties go to the player who set the mark.

EXAMPLE

1. Player A rolls and sets the mark with 3-of-a-Kind (3 Kings) and places the corresponding point value of 30 chips into the pot. He then passes the GRAND TIBBITS TM dice to the player on his left, player B.

2. Player B rolls and beats the mark with a Full House (3 Kings and 2 Queens), and adds the corresponding point value of 40 chips into the pot. He then passes the GRAND TIBBITS TM dice to the next player on his left, player C.

3. Player C rolls and beats the mark with a Flush (5 hearts), and adds the corresponding point value of 50 chips into the pot. He then passes the GRAND TIBBITS TM dice to the next player on his left, player D.

4. Player D rolls and fails to beat a Heart Flush, missing the mark. Because player D could not beat player C's mark, player C collects the pot. The pot is surrendered to player C.

5. Player D now begins the next round by rolling to set the mark.

Play continues in this fashion until all the chips are gone. The player with the highest value in chips at the end of the game is the winner.

While the embodiments described above are all dice and sets thereof bearing playing card symbols and values, the invention may be embodied in other specific forms with out departing from the spirit or other essential characteristics thereof. For example, the first set of symbols may be a set of colors and the second set of symbols may consist of warships, infantry and/or planes. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A set of plural identical dice wherein each die has twenty identically shaped flat surfaces, and wherein each surface of each die bears a first symbol selected from a first set of symbols and a second symbol selected from a second set of symbols, said first symbol and said second symbol being combined together on said die to indicate all possible combinations of said first set symbols and said second set symbols, with each surface on said die indicating a different one of said possible values.

2. The dice set of claim 1 wherein said first symbol is a card suit symbol and said second symbol is a card value symbol, said first symbol and said second symbol together indicating one of the fifty-two different cards in a standard deck of playing cards.

3. The dice set of claim 2 wherein each die has five different value symbols for each of the four card suits symmetrically arranged thereon.

4. The dice set of claim 3 consisting of five identical dice.

5. The dice set of claim 1 wherein one of said sets of symbols is a set of different colors.

6. The dice set of claim 1 wherein each die has paired, opposing surfaces bearing the same second set symbol and no two surfaces adjoining along a common edge bear the same first set symbol.

* * * * *